US006694959B1

(12) United States Patent
Miwa et al.

(10) Patent No.: US 6,694,959 B1
(45) Date of Patent: Feb. 24, 2004

(54) IGNITION AND INJECTION CONTROL SYSTEM FOR INTERNAL COMBUSTION ENGINE

(75) Inventors: Tetsuya Miwa, Nagoya (JP); Hideki Kawamura, Chita-gun (JP); Tomonari Chiba, Nishikamo-gun (JP)

(73) Assignee: Denso Corporation, Aichi-Pref. (JP)

( * ) Notice: Subject to any disclaimer, the term of this patent is extended or adjusted under 35 U.S.C. 154(b) by 271 days.

(21) Appl. No.: 09/713,228

(22) Filed: Nov. 16, 2000

(30) Foreign Application Priority Data

Nov. 19, 1999 (JP) ..... 11-329906
Nov. 29, 1999 (JP) ..... 11-337821

(51) Int. Cl.[7] ..... F02P 15/08
(52) U.S. Cl. ..... 123/637; 123/636; 123/406.53
(58) Field of Search ..... 123/406.53, 636, 123/637

(56) References Cited

U.S. PATENT DOCUMENTS

| | | | | |
|---|---|---|---|---|
| 3,910,243 A | * | 10/1975 | Gau et al. | 123/406.53 |
| 4,373,671 A | | 2/1983 | Giardini | |
| 4,381,752 A | | 5/1983 | Hill | |
| 4,517,952 A | | 5/1985 | Hosoya | |
| 5,415,136 A | | 5/1995 | Doherty et al. | |
| 5,553,594 A | | 9/1996 | Ehlers et al. | |
| 5,706,783 A | | 1/1998 | Sawada | |
| 5,724,943 A | | 3/1998 | Blount et al. | |
| 5,857,449 A | | 1/1999 | Ishikawa et al. | |
| 5,875,763 A | * | 3/1999 | Mottier et al. | 123/406.13 |
| 5,893,349 A | * | 4/1999 | Rado | 123/406.42 |
| 5,954,025 A | * | 9/1999 | Kanamaru et al. | 123/339.11 |
| 6,085,733 A | | 7/2000 | Motoyama et al. | |
| 6,173,692 B1 | * | 1/2001 | Hellmich et al. | 123/305 |
| 6,266,957 B1 | * | 7/2001 | Nozawa et al. | 60/284 |
| 6,339,743 B1 | * | 1/2002 | Young et al. | 701/115 |
| 6,453,664 B2 | * | 9/2002 | Ishii et al. | 60/284 |

FOREIGN PATENT DOCUMENTS

| | | |
|---|---|---|
| JP | 2-218870 | 8/1990 |
| JP | 8-014094 A | 1/1996 |
| JP | B2-2744256 | 2/1998 |
| WO | WO 98/25210 | 6/1998 |

* cited by examiner

*Primary Examiner*—John Kwon
(74) *Attorney, Agent, or Firm*—Nixon & Vanderhye PC

(57) ABSTRACT

During a multiple discharges operation, a micro computer changes a discharge period of each discharge in accordance with a pressure transition in a combustion chamber of an internal combustion engine. Thus, the energy amount consumed at each discharge of the multiple discharges operation is suppressed toward the minimum requirement, and the consumption of energy accumulated in the ignition device is appropriately controlled. As a result, discharge energy is efficiently consumed at the multiple discharges, thereby compacting the ignition device. Further, the number of multiple discharges is not restricted.

10 Claims, 17 Drawing Sheets

FIG. 18

| PATTERNS | IGA | IGB | WTG | WTJ | RESULTS |
|---|---|---|---|---|---|
| 1 | ON | ON | ON | OFF | IG01 |
| 2 | ON | OFF | ON | OFF | IG02 |
| 3 | OFF | ON | ON | OFF | IG03 |
| 4 | OFF | OFF | ON | OFF | IG04 |
| 5 | ON | ON | OFF | ON | IJ01 |
| 6 | ON | OFF | OFF | ON | IJ02 |
| 7 | OFF | ON | OFF | ON | IJ03 |
| 8 | OFF | OFF | OFF | ON | IJ04 |

IGNITION AND INJECTION CONTROL SYSTEM FOR INTERNAL COMBUSTION ENGINE

CROSS REFERENCE TO RELATED APPLICATION

This application is based on and incorporates herein by reference Japanese Patent Application Nos. Hei. 11-329906 filed on Nov. 19, 1999, and Hei. 11-337821 filed on Nov. 29, 1999.

BACKGROUND OF THE INVENTION

1. Field of the Invention

The present invention relates to an ignition and injection control system for an internal combustion engine suitable for use in a vehicle.

2. Description of Related Art

Conventionally, an ignition control system executes a multiple electric discharges operation. In the multiple electric discharges operation, a plurality of discharges are carried out during one engine combustion cycle. For executing the multiple discharges, for example, an ECU outputs an ignition signal IGt to energize and de-energize the primary coil of an ignition coil repeatedly. Thereby, high voltage is introduced in the secondary coil of the ignition coil, and the ignition coil multiply discharges.

The above described multiple discharges operation will be explained in more detail with reference to FIG. 14.

According to the example in FIG. 14, when a gasoline injection type internal combustion engine cold starts, the ignition timing thereof is retarded to 100 CA after compression top dead center, and a multiple discharges operation discharging five times is executed. Each discharge interval and discharge period are fixed. The discharge interval is set to 1 ins, and each discharge period is set to 0.4 ins. Here, the last (fifth) discharge period is not determined. The engine rotation number is set to 1200 rpm.

When the ignition signal IGt falls down, primary electric current i1 in the ignition coil is shut off, and secondary electric current i2 and secondary voltage V2 are introduced as shown in FIG. 14. Further, as the multiple discharges operation proceeds, the primary electric current i1, the secondary electric current i2, and the secondary voltage V2 change as shown in FIG. 14.

Here, the product of secondary electric current i2 and secondary voltage V2 corresponds to energy density. The energy density reduces as the number of discharges is increased. Since the product of energy density and discharge period corresponds to the discharge energy amount, the discharge energy amount for each discharge reduces as the discharge is repeated. However, the required energy amount for introducing a required spark at each discharge gradually increases. The required energy amount is denoted by slant lines area in FIG. 14. According to experiments conducted by the inventors, when the air-fuel ratio (A/F) of an air-fuel mixed gas is 17, the required discharge energy is 3.5 mJ at the first discharge. The required discharge energy increases as the discharge is repeated, and the discharge energy reaches 9.3 mJ at the fifth discharge. Here, the required energy density is 22 mJ/ms at the first discharge, and is 25 mJ/ms at the fifth discharge.

As is understood from the experiments, as the discharge is repeated, the energy amount introduced by discharge becomes smaller than the required energy amount. Thus, the multiple discharges operation cannot be executed.

An engine control system calculates fuel injection amount and ignition timing. The engine controller outputs an injection signal for each cylinder into an injection operating circuit, and outputs an ignition signal for each cylinder into an ignition operating circuit, for introducing a spark discharge at each ignition plug.

However, the ignition operating circuit and the injection operating circuit are independently formed and arranged far from each other. Thus, even when there is a function device commonly used for both circuits, the function device cannot be shared from a circuit arrangement standpoint, thereby enlarging the circuit scale and increasing the manufacturing cost.

According to the conventional engine control system, the number of signal lines, which lead ignition and injection signals from the engine control computer to each cylinder, is large. Thus, a wide wiring space is needed, and the arrangement of the signal lines becomes complicated, thereby increasing the manufacturing cost.

According to the conventional engine control system, a combustion sensor is provided in each cylinder, thereby increasing the manufacturing cost.

Coils in the ignition operating circuit and the injection operating circuit discharge remaining magnetic energy just after the coils are de-energized. However, the energy is emitted as a heat and is not effectively used.

SUMMARY OF THE INVENTION

A first object of the present invention is to supply discharge energy effectively during a multiple discharges operation, and to reduce the size of an ignition device.

According to a first aspect of the present invention, during the multiple discharges operation, an ignition control means changes a discharge period of each discharge in accordance with a pressure transition in a combustion chamber of an internal combustion engine. Alternatively, the ignition control means 15 sets a discharge period of each discharge during the multiple discharges operation in such a manner that the discharge period is set shorter as the discharge timing more closes to a compression top dead center.

Thus, the energy amount consumed at each discharge of multiple discharges operation is suppressed toward the minimum requirement, and the consumption of energy accumulated in the ignition device is appropriately controlled. As a result, discharge energy is efficiently consumed at the multiple discharges, thereby compacting the ignition device. Further, the number of multiple discharges is not restricted.

A second object of the present invention is to simplify a circuit arrangement for an engine control to reduce the manufacturing cost.

According to a second aspect of the present invention, an ignition operating circuit and an injection operating circuit are integrated with each other, and the ignition operating circuit and the injection operating circuit commonly share a function device used for both circuits.

Thus, the wiring pattern is simplified between the ignition operating circuit and the injection operating circuit, and the ignition operating circuit and the injection operating circuit easily share the function device commonly used for both circuits. Therefore, circuit arrangement of ignition and injection systems and assembling procedure are simplified, thereby reducing the manufacturing cost.

A third object of the present invention is to effectively use a remaining energy between the ignition operating circuit and the injection operating circuit.

According to a third aspect of the present invention, an energy recovery circuit is provided to get back a remaining energy in one of the ignition operating circuit and the injection operating circuit, and to supply the remaining energy into the other operating circuit.

Thus, the remaining magnetic energy is effectively consumed, thereby improving fuel consumption.

BRIEF DESCRIPTION OF THE DRAWINGS

Additional objects and advantages of the present invention will be more readily apparent from the following detailed description of preferred embodiments thereof when taken together with the accompanying drawings in which:

FIG. 18 is a table explaining cylinder determination and ignition/injection determination based on the on/off combinations of four signals IGA, IGB, WTG, and WTJ (fourth embodiment);

DETAILED DESCRIPTION OF PREFERRED EMBODIMENTS

First Embodiment

In an internal combustion engine, for example,s a spark ignition 4-cycle 4-cylinder engine, the ignition timing thereof is controlled by an ECU. In this engine, a plurality of electric discharges are carried out during one combustion cycle. That is, multiple discharge is executed.

Figure 1:
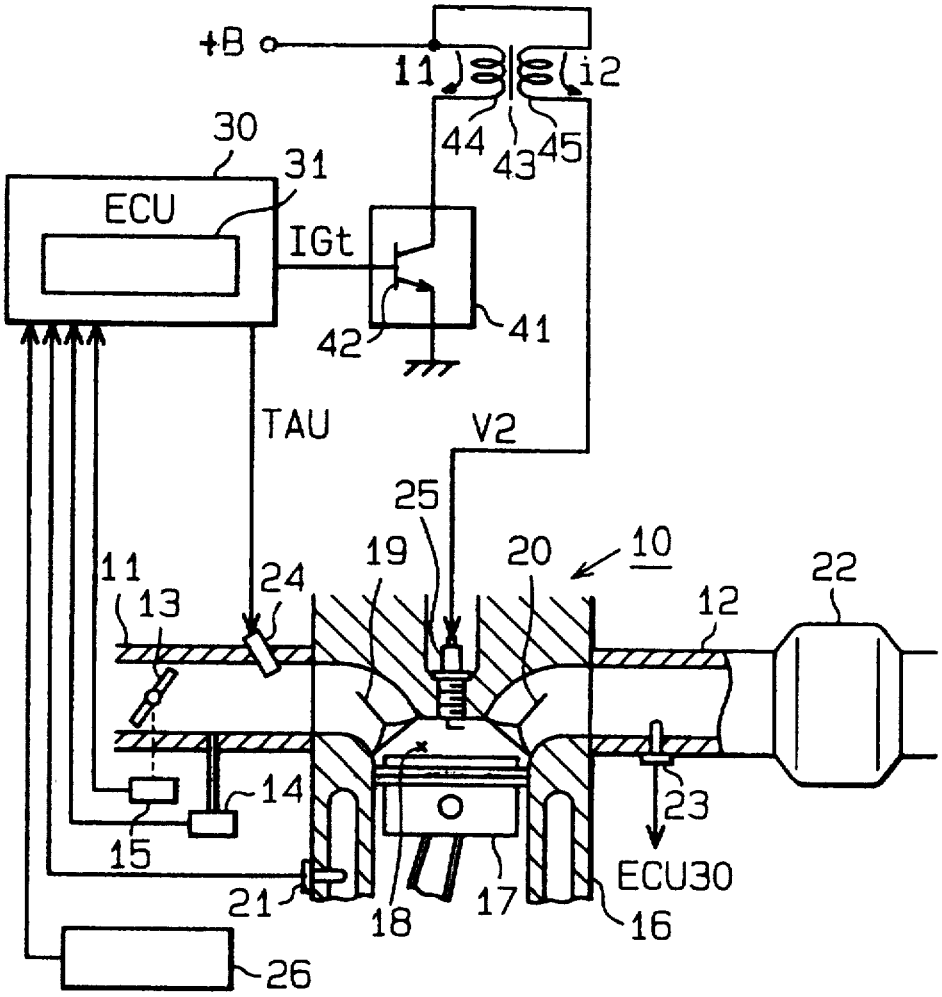
FIG. 1 is a schematic view showing an ignition control system (first embodiment)

FIG. 1 is a schematic view showing an engine control system of the present invention. As shown in FIG. 1, an intake port of an engine 10 connects with an intake pipe 11, and an exhaust port of the engine 10 connects with an exhaust pipe 12. In the intake pipe 11, a throttle valve 13 and an intake air pressure sensor 14 are provided. The throttle valve 13 interlocks with an accelerate pedal (not illustrated), and the intake air pressure sensor 14 detects an air pressure inside the intake air pipe 11. A throttle sensor 15 detects an opening degree of the throttle valve 13. The throttle sensor 15 also detects a full close position (idle position) of the throttle valve 13.

A piston 17 is provided in a cylinder 16 of the engine 10. The piston 17 vertically reciprocates in accordance with the rotation of an engine crank shaft. A combustion chamber 18 is provided above the piston 17, and communicates with the intake pipe 11 and the exhaust pipe 12 through an intake valve 19 and an exhaust valve 20, respectively. A water temperature sensor 21 is provided in the cylinder 16 (water jacket). The water temperature sensor 21 detects an engine coolant temperature.

A catalytic converter 22 containing three way catalyst is provided in the exhaust pipe 22. A limiting current Air/Fuel sensor 23 is provided at the upstream side of the catalytic converter 22. The A/F sensor 23 outputs a wide range and linear air-fuel ratio signal in proportion to the oxygen concentration in the exhaust gas (or the carbon monoxide concentration in unburned gas). Here, the A/F sensor 23 may be replaced with an $O_2$ sensor outputting different voltage signals between a rich side and a lean side with respect to a theoretical air-fuel ratio.

An electromagnetic injector 24 is provided in each division pipe of an intake manifold. The injector 24 injects a fuel into the engine intake port by receiving an electric current. An ignition plug 25 is provided in each cylinder of the engine 10. New air supplied from the intake pipe is mixed with the fuel injected from the injector 24 at the engine intake port. When the intake valve 19 opens the intake port, the mixed air-fuel gas flows into the combustion chamber 18. The mixed air-fuel gas is ignited by the ignition plug 25 to be burned.

The ECU 30 includes a micro computer 31. Output signals from the intake air pressure sensor 14, the throttle sensor 15, the water temperature sensor 21, and the A/F sensor 23 are input into the ECU 30. Further, a pulse signal output every predetermined crank angle from a rotation number sensor 26 is input into the ECU 30. The micro computer 31 calculates an optimum fuel injection amount based on the miscellaneous parameters from these sensors, which shows an engine condition, and outputs the optimum fuel injection amount as an injection signal TAU into the injector 24. Further, the micro computer 31 calculates an optimum ignition timing based on the parameters, and outputs it as an ignition signal IGt into an igniter 41.

The ignition signal IGt output from the micro computer 31 is input into a base terminal of a power transistor 42 installed in the igniter 41. One end of a primary coil 44 of a ignition coil 42 is connected to a connector terminal of the power transistor 42, and the other end of the primary coil 44 is connected to a vehicle battery. A secondary coil 45 of the ignition coil 43 is connected to the ignition plug 25.

When the engine works, the power transistor 42 is on/off controlled in accordance with build-up/fall-down of the ignition signal IGt. When the power transistor 42 is energized, a primary electric current ii is charged into the primary coil 44 by vehicle battery voltage+B. When the power transistor 42 is de-energized, the primary electric current into the primary coil 44 is shut off, and high voltage (secondary electric current i2) is charged into the secondary coil 45. The high voltage introduces an ignition spark between electrodes of the ignition plug 25.

Figure 3A:
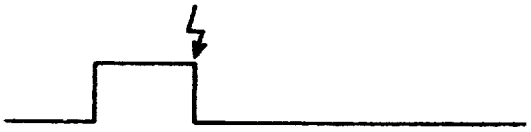
FIG. 3A shows an ignition pulse wave of normal single discharge operation (first embodiment)
Figure 3B:
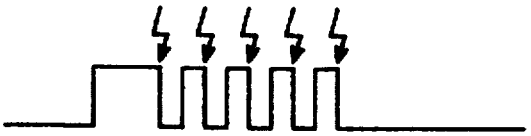
FIG. 3B shows an ignition pulse wave of multiple discharges operation (first embodiment)

According to the present embodiment, multiple electric discharges in which a plurality of discharges are carried out during one combustion cycle are executed. The multiple electric discharges are executed by repeating the on/off control of the power transistor 42 to repeat energizing/de-energizing the primary coil 44. That is, the multiple electric discharges are done by controlling a current supply time and a current shut time for the primary coil 44. FIGS. 3A and 3B show pulses of a normal ignition signal IGt and of a multiple discharges ignition signal IGt, respectively. In FIG. 3A, one pulse signal is output during one combustion cycle. In FIG. 3B, a plurality of pulse signals are output during one combustion cycle.

Figure 2:
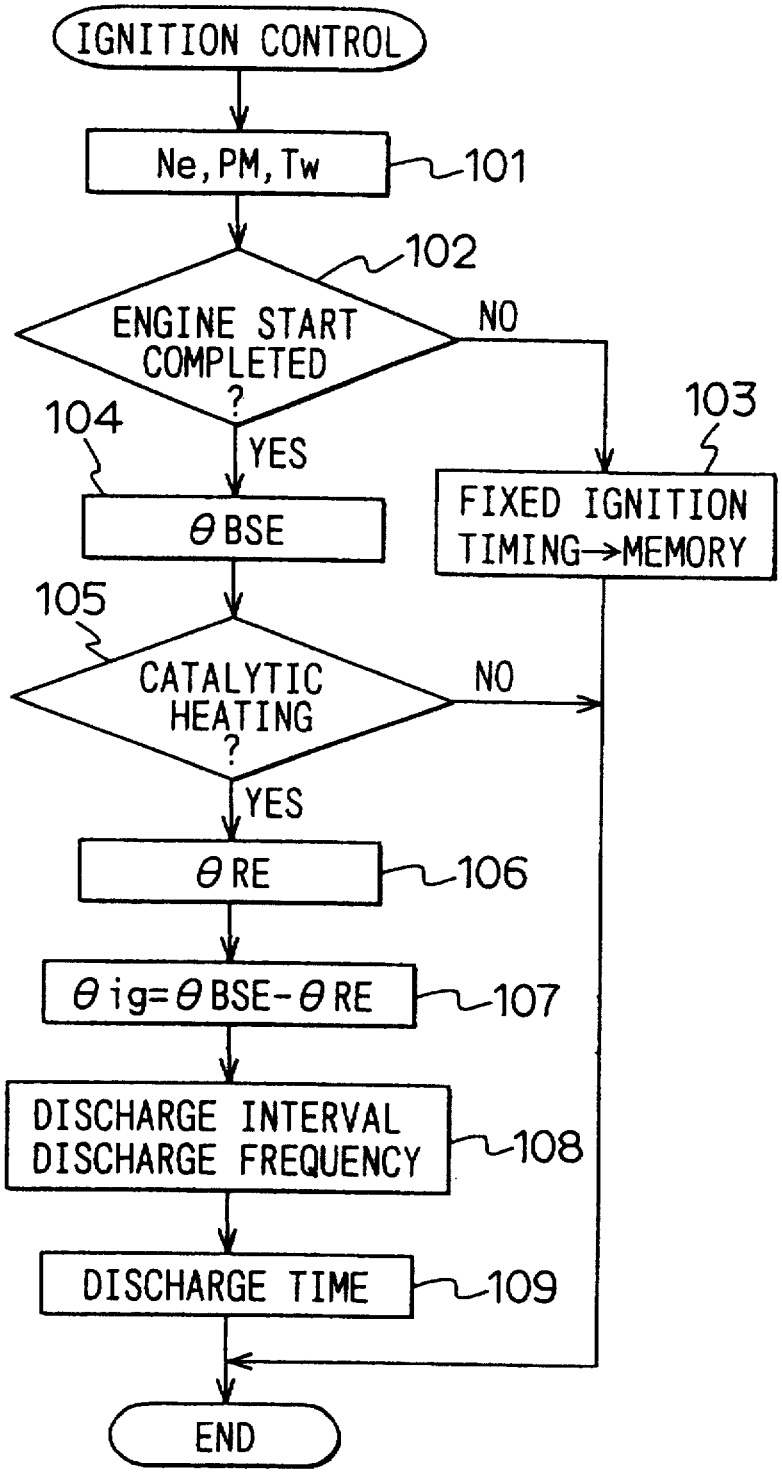
FIG. 2 is a flow chart showing an ignition control (first embodiment)

An ignition control of the micro computer 31 will now be explained. FIG. 2 shows a flow chart of the ignition control. The micro computer 31 executes one routine in FIG. 2 every predetermined period (for example, every 10 ins). This execution corresponds to operation of ignition control means and ignition timing retard means of the present invention. In the present embodiment, when the engine 10 cold starts, the ignition timing is controlled toward the retard side to early activate (heat) the catalytic converter 22. Further, the multiple electric discharges are carried out to suppress a torque fluctuation at the ignition timing retard control.

In FIG. 2, engine rotation number Ne, intake pipe pressure PM, and engine water temperature Tw are input into the ECU 30 (STEP 101). Next, the ECU 30 determines whether an engine start is completed or not (STEP 102). For example, the ECU 30 determines the engine start is completed (YES at STEP 102) if the engine rotation number Ne is over 400 rpm.

If the engine start is not completed, the flow goes to STEP 103, and a predetermined ignition timing (for example, BTDC5° CA) is saved at a predetermined address, and the flow goes to END.

If the engine start is completed, the flow goes to STEP 104, and the ECU 30 calculates a basic ignition timing 0 BSE. Here, the ECU 30 determines whether the engine 10 idles or not based on the engine rotation number Ne. When the engine 10 idles, the ECU 30 calculates the basic ignition timing 0 BSE based on the engine rotation number Ne. When the engine 10 does not idle, the ECU 30 calculates the basic ignition timing 0 BSE based on the engine rotation number Ne and the intake air pressure PM by using a predetermined map. In general, when the engine rotates by high speed, the basic ignition timing 0 BSE is set at the spark advance side. When the engine 10 just starts, in general, the basic ignition timing 0 BSE is set around BTDC10° CA.

After that, the ECU 30 determines whether the early activation of the catalytic converter 22 should be done or not (STEP 105). For example, when all of the following items are satisfied, the ECU 30 permits the early activation, but when at least one of the following items is not satisfied, the ECU 30 prohibits the early activation.

(1) Engine rotation number Ne is within a range 400–2000 rpm.

(2) Engine water temperature Tw is within a range 0–60° C.

(3) Gear of automatic transmission is positioned at P (parking) or N (neutral) range (manual transmission is positioned at neutral range).

(4) It is still within 15 seconds after the engine start is completed.

(5) There is no miscellaneous failure.

When the ECU 30 determines that the early activation should be done, the ECU 30 executes an ignition timing control regarding the early activation (STEPS 106–109). When the ECU 30 determines it should not execute the early activation, the flow goes to END to finish the present routine.

Figure 4:
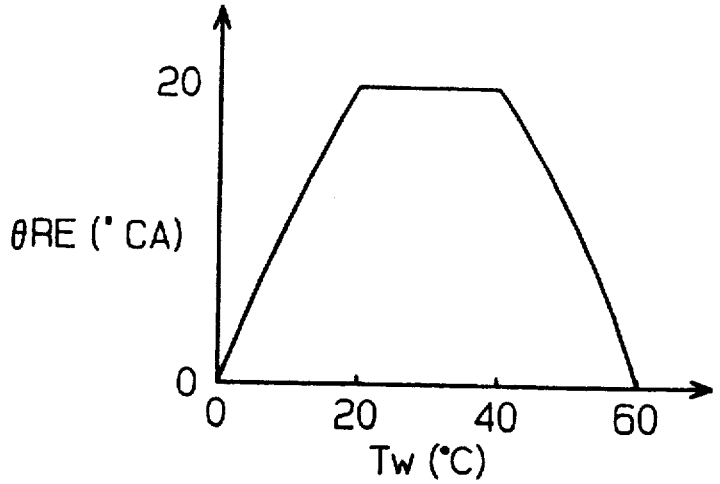
FIG. 4 is a graph showing a relation between engine water temperature and retard correction (first embodiment)

At STEP 106, the ECU 30 calculates a spark retard correction θ RE for the early activation, based on engine water temperature at each time by using a characteristic map in FIG. 4.

According to the characteristic map in FIG. 4, the spark retard correction θ RE is set within a range 0–20° CA based on the engine water temperature Tw. For example, when Tw is within a range 20–40° C., the spark retard correction θ RE is set constant. When Tw is within a range 40–60° C., the spark retard correction θ RE is set smaller as Tw is higher.

After that, at STEP 107, the ECU 30 calculates θ ig by subtracting the spark retard correction θ RE from the basic ignition timing θ BSE (θ ig=θ BSE–θ RE), and saves the θ ig into a predetermined address as new ignition timing.

Figure 5A:
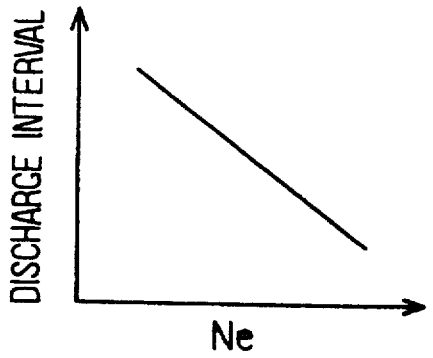
FIG. 5A is a graph showing a relation between engine rotation number and discharge interval (first embodiment)
Figure 5B:
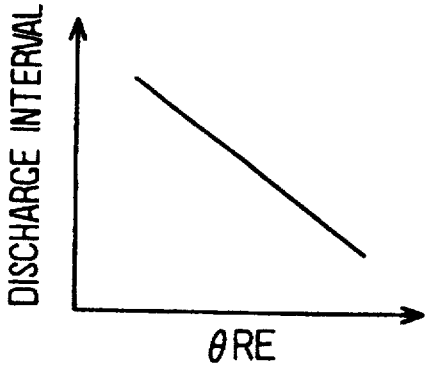
FIG. 5B is a graph showing a relation between ignition timing and discharge interval (first embodiment)
Figure 6A:
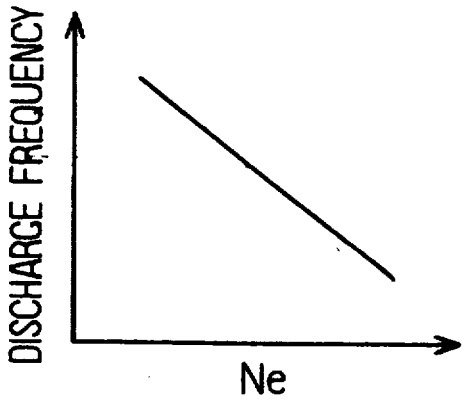
FIG. 6A is a graph showing a relation between engine rotation number and the number of discharges (first embodiment)
Figure 6B:
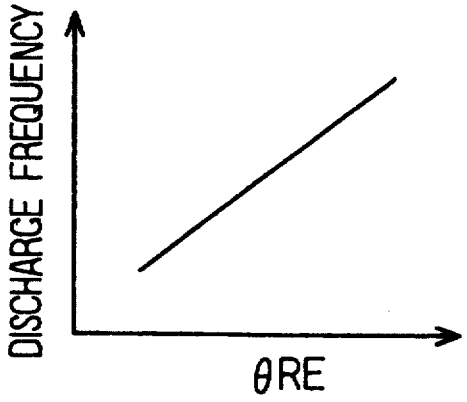
FIG. 6B is a graph showing a relation between ignition timing and the number of discharges (first embodiment)
Figure 6C:
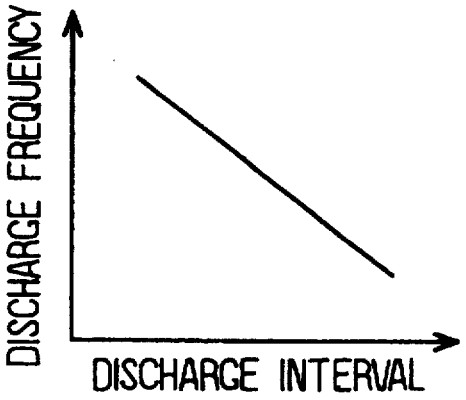
FIG. 6c is a graph showing a relation between discharge interval and the number of discharges (first embodiment)

At STEP 108, the ECU 30 sets the discharge interval and the number of discharges during the multiple discharges operation based on the miscellaneous parameters. During the multiple discharges operation, it is necessary to attain a spark of each ignition and a dispersal of each flare. The ECU 30 sets the discharge interval and the number of discharges at each timing based on the ignition spark and flare dispersal. It is desired to set the discharge interval within a range 0.5–1.5 ins, and the number of discharges within 2–10 times. They may vary independently from each other. The ECU 30 sets the discharge interval in accordance with parameters such as engine rotation number Ne (or engine load), ignition timing (spark retard correction θ RE) and the like by using at least one of the relations in FIGS. 5A and 5B. When the discharge intervals set by FIGS. 5A and 5B are different from each other, the ECU 30 selects the longer one. The ECU 30 sets the number of discharges in accordance with parameters such as engine rotation number Ne (or engine load), ignition timing (spark retard correction θ RE), discharge interval and the like by using at least one of the relations in FIGS. 6A, 6B and 6C. When the number of discharges set by FIGS. 6A–6C are different from each other, the ECU 30 selects the largest one. The engine load may be attained based on the intake air pressure PM or an intake air amount.

At STEP 109, the ECU 30 sets each electric discharge period during the multiple discharges operation, and the flow goes to END.

Figure 7:
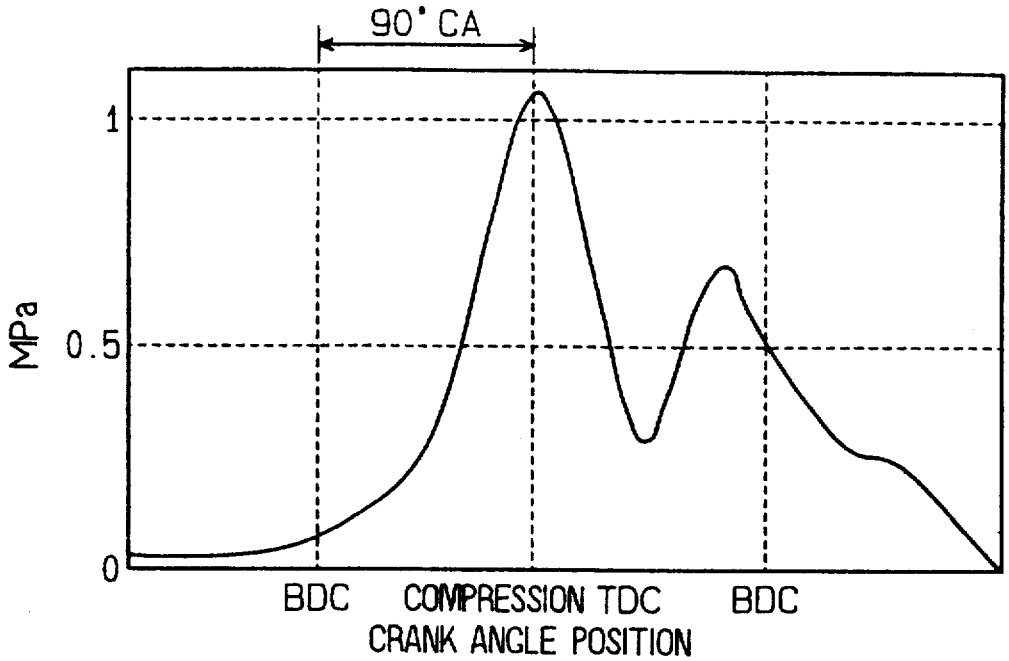
FIG. 7 is a graph showing a relation between crank angle position and pressure inside cylinder (first embodiment)
Figure 8:
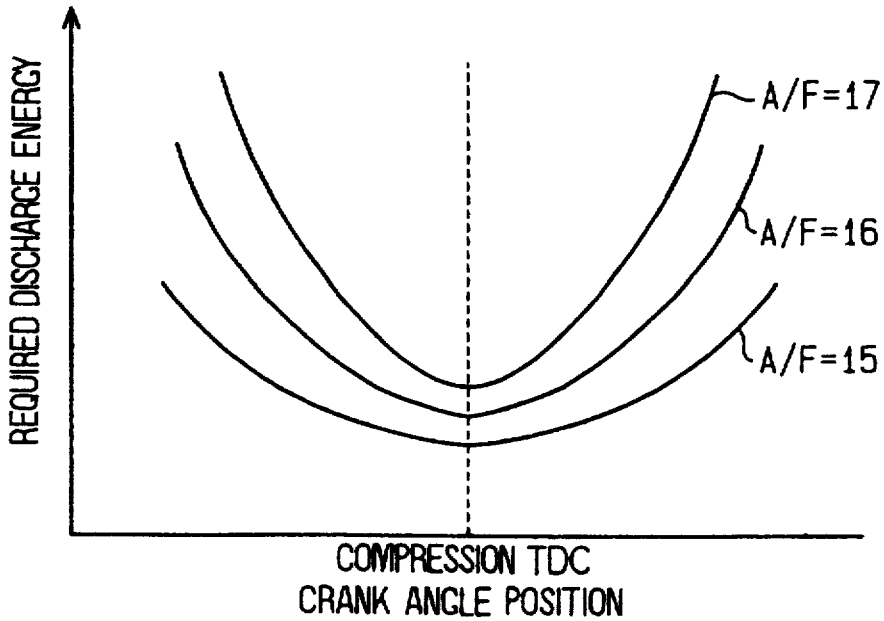
FIG. 8 is a graph showing a relation among crank angle position, required discharge energy amount, and A/F ratio (first embodiment)

FIG. 7 shows a relation between an engine crank angle and pressure inside the cylinder (pressure inside the combustion chamber 18). The pressure inside the cylinder reaches maximum pressure at the compression TDC position. After the pressure inside the cylinder starts to fall down, the mixed air-fuel gas is ignited to be burned, so that the pressure inside the cylinder temporally rises due to the combustion pressure. When the crank angle closes to the compression TDC and the pressure inside the cylinder becomes higher, the energy level of the mixed gas increases, and the discharge energy needed for ignition varies. That is, as shown in FIG. 8, as the crank angle closes to the compression TDC where the pressure inside the cylinder becomes the maximum, the discharge energy needed for ignition can be small.

The discharge energy needed for ignition increases as the A/F ratio of the mixed gas becomes leaner. As is understood from comparing A/F=17, A/F=16, and A/F=15 in FIG. 8 with each other, the discharge energy needed for ignition increases as the A/F ratio becomes leaner.

Thus, paying attention to that the discharge energy for ignition varies as described above, each discharge period during the multiple discharges operation is appropriately changed. According to the present embodiment, a relation between the crank angle position and the needed discharge energy is previously attained, and a relation between the number of discharges and the discharge period is patterned based on the relation between the crank angle position and the needed discharge energy.

Figure 9:
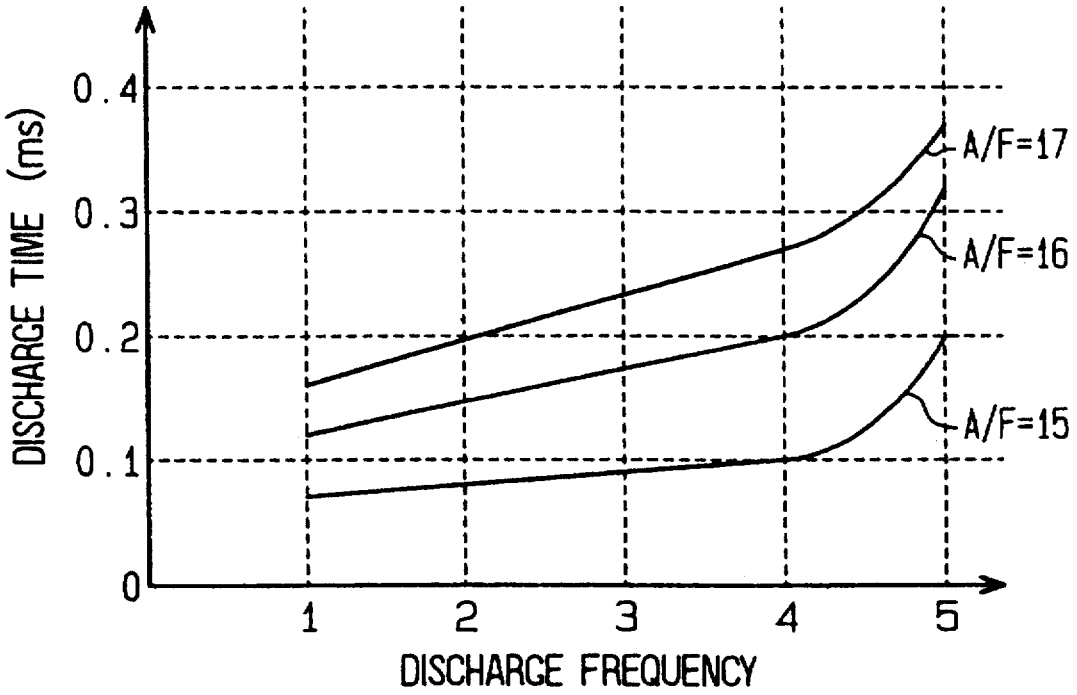
FIG. 9 is a graph showing a relation among the number of discharges, discharge period, and A/F ratio (first embodiment)

For example, under the condition that ignition timing= ATDC10° CA, Ne=1200 rpm, discharge interval=1 ms, and the number of intervals=5, the pressure inside the cylinder is 1.0 MPa at the first discharge. After that, the pressure inside the cylinder decreases to 0.4 MPa at the fifth discharge by repeating discharges every 1 ms. In this case, the optimum discharge period is set as shown in FIG.9. Examples are described hereinafter.

(1) When A/F=17, the first through fifth discharge periods are set to "0.16–0.37 ms".

(2) When A/F=16, the first through fifth discharge periods are set to "0.12–0.32 ms".

(3) When A/F=15, the first through fifth discharge periods are set to "0.07–0.20 ms".

These discharge periods are the minimum requirement for attaining the ignition energy. When the ignition coil 43 accumulates sufficient energy, the discharge periods had better be set appropriately longer for attaining combustion stability of the engine 10.

At STEP 109 in FIG. 2, each discharge period is calculated based on ignition timing, discharge interval, the number of discharges, A/F ratio and the like. When a multiple discharges operation is executed after the compression TDC, discharge period is gradually set longer as the electric discharges are repeated.

The micro computer 31 calculates an ignition signal IGt based on the ignition timing, discharge interval, the number of discharges, and discharge period, and outputs the ignition signal IGt into the igniter 41.

Figure 10:
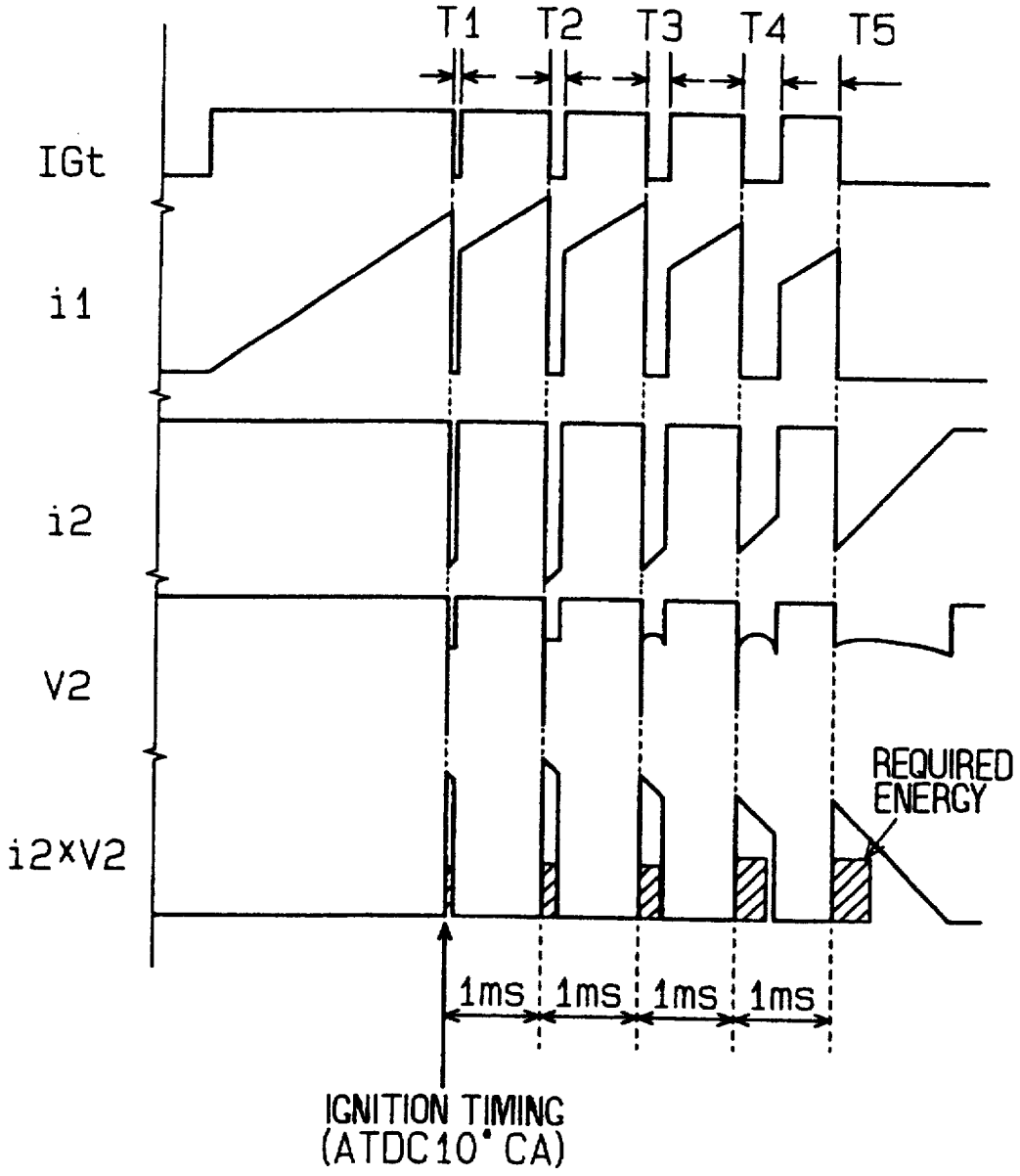
FIG. 10 is a time chart showing a multiple discharges operation (first embodiment)

FIG. 10 is a time chart explaining the multiple discharges operation. FIG. 10 shows an example in which the spark timing is set ATDC10° CA.

The electric discharges are repeated five times in accordance with the ignition signal IGt, and the accumulated energy in the ignition coil 42 is consumed at each electric discharge. Each discharge period is, as denoted by Ti, T2, T3, T4 and T5 in FIG. 10, gradually set longer. Here, remaining energy in the ignition coil 43 can be consumed at the last (fifth) discharge, so that the fifth discharge period T5 need not be accurately controlled. That is, the last (fifth) discharge period T5 has only to be at least longer than the above described discharge period.

According to FIG. 10, the energy amount at each electric discharge is always over the required energy amount for ignition (slant lines area in FIG. 10), and sufficient energy remains even at the last discharge. Here, the energy is not consumed excessively, thereby suppressing the energy from being wasted.

As described above, according to the present embodiment, when a multiple discharges operation is executed, the discharge period is set shorter as discharge timing more closes to the compression TDC while chasing transition of the pressure inside the cylinder. Thus, the energy amount consumed at each discharge of the multiple discharges operation is suppressed toward the minimum requirement, and consumption of energy accumulated in the ignition coil 43 is appropriately controlled. As a result, the discharge energy is efficiently consumed at the multiple discharges, thereby compacting the ignition coil 43. Further, the number of multiple discharges is not restricted.

The ECU 30 calculates the discharge period based on the pressure inside the cylinder and A/F ratio of the mixed gas, and sets the discharge period longer as the mixed gas is leaner. Thus, the ignition control is carried out more accurately.

The number of discharges and the discharge interval are set based on the engine driving condition. Thus, optimum multiple discharges balancing the driving condition is executed.

The multiple discharges are executed in accordance with spark retard control at the cold start of the engine 10. Thus, the catalytic converter 22 is activated early. An engine combustion condition, which tends to be unstable due to the spark retard, is stabilized. The discharge energy of the ignition coil 43 is appropriately controlled.

Second Embodiment

In the first embodiment, the multiple discharges operation is applied at the cold start of a port injection type engine. According to the present second embodiment, the multiple discharges operation is applied to a cylinder inside injection type engine. The multiple discharges operation is executed for igniting stratified mixed gas with certainty at stratified combustion of the engine to prevent an accidental fire.

In the second embodiment, a high-pressure swirl injector is provided under the intake port of the engine 10 in FIG. 1. High pressure fuel is injected from this injector toward the top of the piston inside the combustion chamber. The piston includes a concave portion at the top surface thereof. Fuel injection flow from the injector is led along the inner periphery surface of the concave portion toward the spark point (tip end) of the ignition plug 25.

Figure 11:
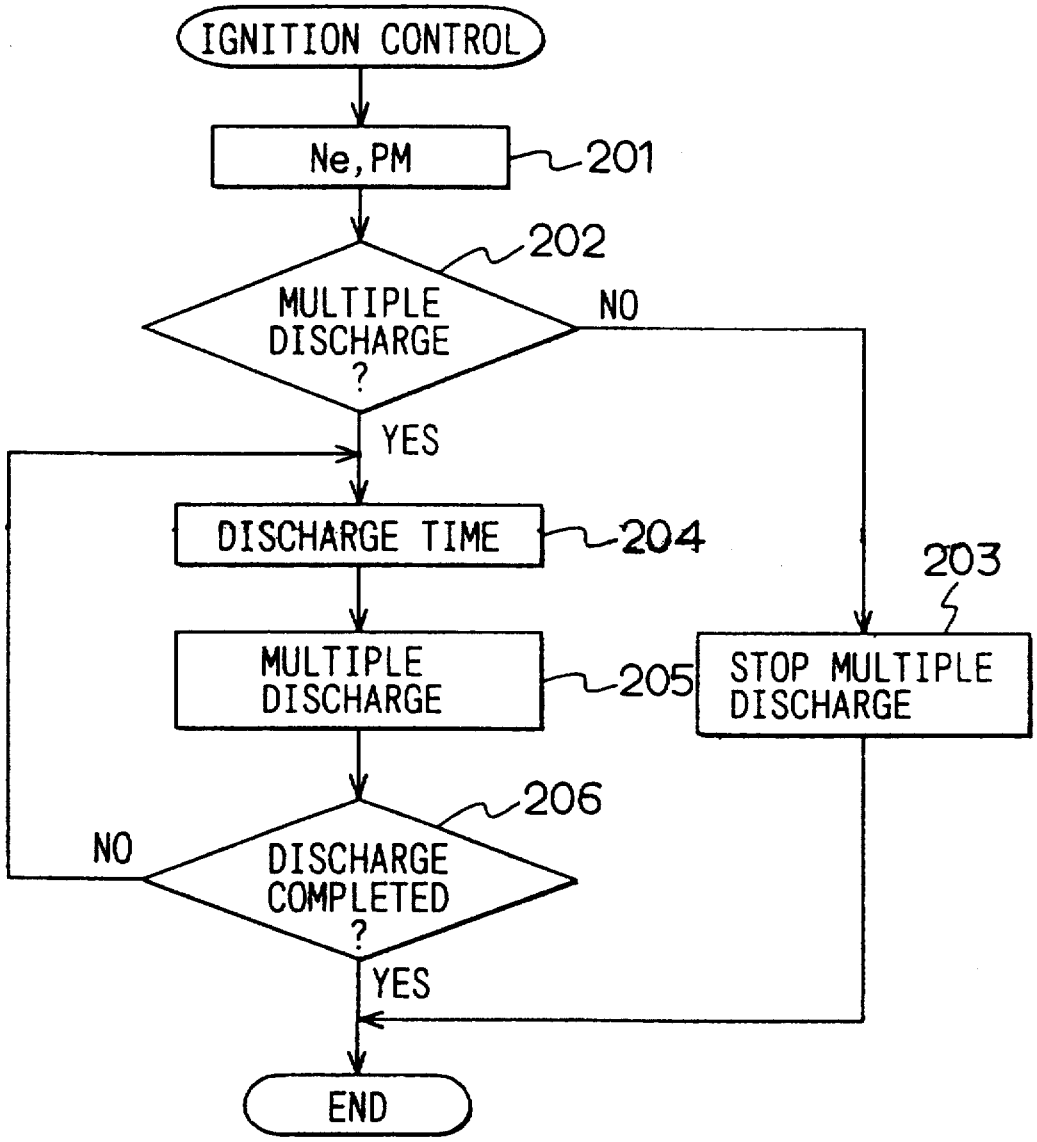
FIG. 11 is a flow chart showing an ignition control (second embodiment)

FIG. 11 shows a flow chart of the ignition control. This execution corresponds to an ignition control means of the present invention. The micro computer 31 starts to execute the control at ignition timing.

Figure 12:
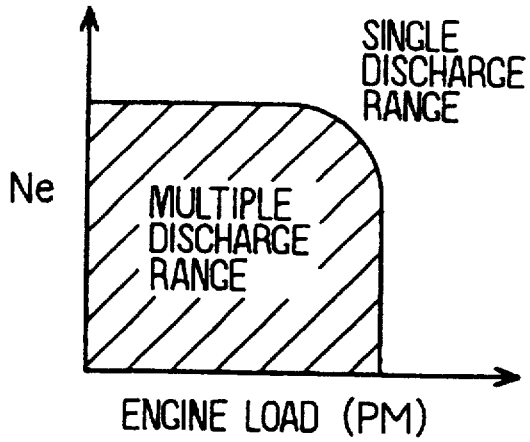
FIG. 12 is a graph showing single discharge range and multiple discharges range (second embodiment)

In FIG. 11, engine rotation number Ne and intake air pressure PM (engine load) are input into the ECU 30 (STEP 201). Next, the ECU 30 determines whether a driving condition is within the multiple discharges range or not. That is, the ECU 30 determines whether both engine rotation number Ne and engine load are under predetermined values or not, based on a discharge range map in FIG. 12. As shown in FIG. 12, the multiple discharges range defines a range where both engine rotation number Ne and engine load are under predetermined values respectively.

When the ECU 30 determines it is not within the multiple discharges range, but within the single discharge range, the flow goes to STEP 203 to discharge only once. That is, after normal primary electric current ii is normally shut off, the ECU 30 keeps de-energizing the power transistor 42 (see FIG. 1) so as not to carry out the multiple discharges operation.

When the ECU 30 determines it is within the multiple discharges range, the flow goes to STEP 204. At STEP 204, the ECU 30 calculates each discharge period at the multiple discharges operation. The ECU 30 calculates each discharge period based on the above described ignition timing, discharge interval, the number of discharges, A/F ratio and the like. Here, the discharge period is set shorter as discharge timing more closes to the compression TDC while chasing transition of the pressure inside the cylinder.

At STEP 205, after the primary electric current ii is normally shut off, the power transistor 42 is repeatedly energized and de-energized every constant interval to allow the ignition plug 25 to repeatedly discharge. After that, at STEP 206, the ECU 30 determines whether the number of discharges has reached a predetermined number or not, and continues to execute multiple discharges operation until the number of discharges reaches the predetermined number. Here, the number of discharges may be set based on relations in FIGS. 6A–6C as in the procedure in FIG. 2.

As described above, according to the present second embodiment, the discharge energy is effectively consumed by the multiple discharges as in the first embodiment, thereby compacting the ignition coil 43. Further, the number of multiple discharges is not restricted. Especially in the cylinder inside injection type engine, even when timing of relatively rich mixed gas (stratified mixed gas) reaching the ignition plug 25 deviates from the calculated timing a little, the multiple discharges operation is executed for igniting the mixed gas with certainty to prevent an accidental fire.

Modifications

Figure 13:
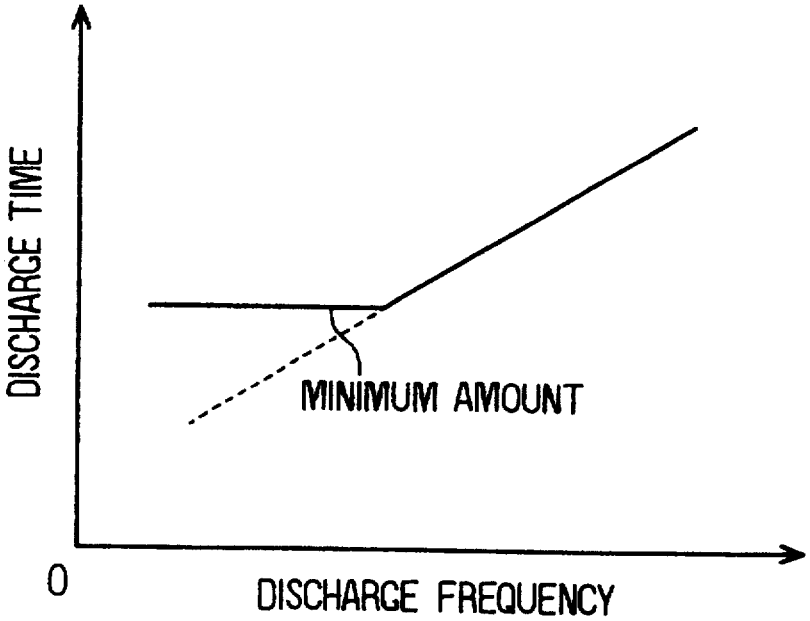
FIG. 13 is a graph showing the number of discharges and discharge interval (Modifications)
Figure 14:
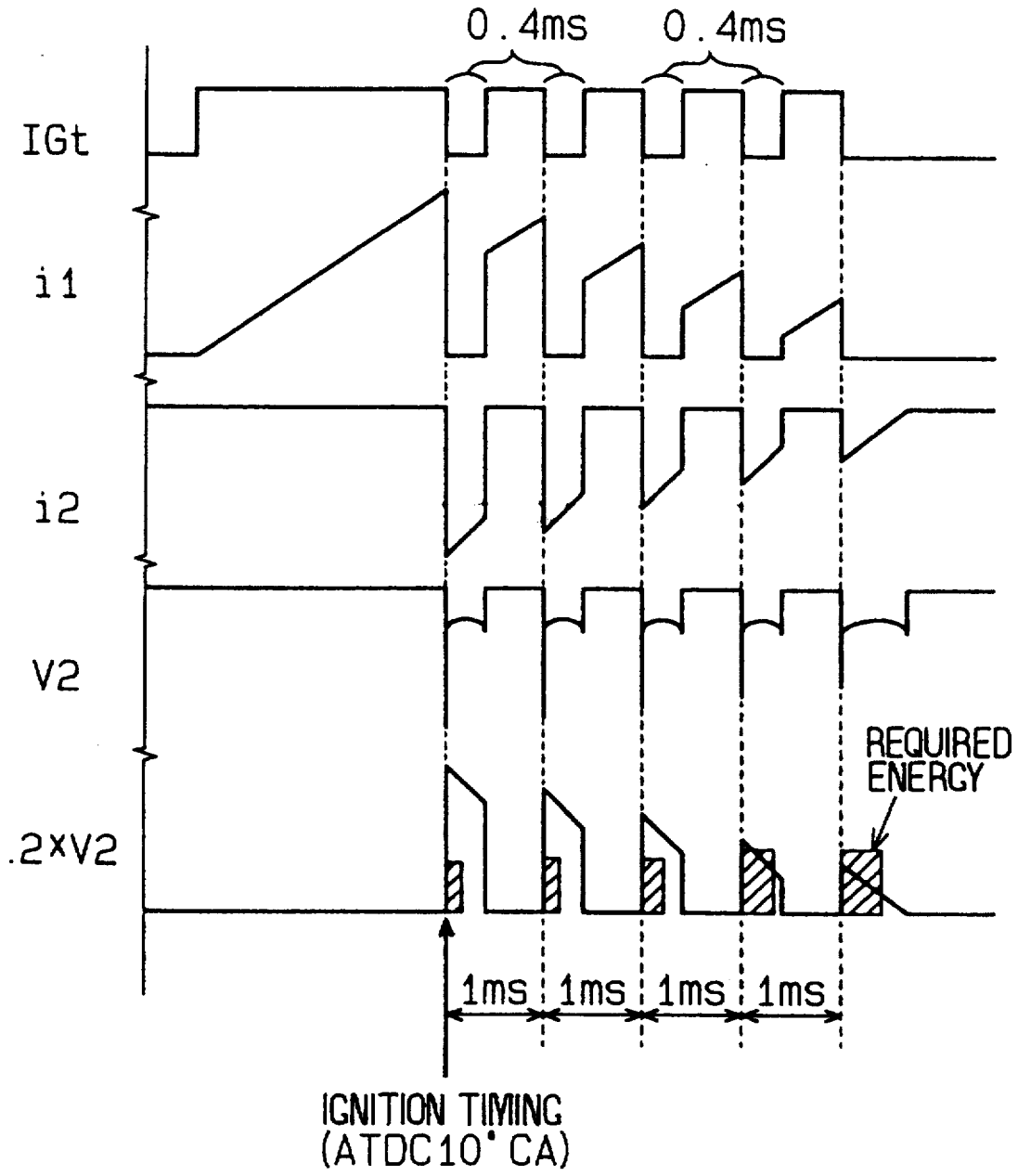
FIG. 14 PRIOR ART
FIG. 14 is a time chart showing a multiple discharges i operation (Prior Art)

According to the above described embodiments, as shown in FIG. 9, when A/F ratio is constant, discharge period at the multiple discharges is set uniformly longer as the number of discharges increases (farer from compression TDC) at ATDC ignition. Alternatively, as shown in FIG. 13, the minimum 20 discharge period may be previously determined, and discharge period may be set over the minimum period. FIG. 13 shows an example of ATDC ignition.

That is the discharge period is not uniformly changed in accordance with the pressure inside the cylinder and advance amount or retard amount from the compression TDC. The discharge period is restricted by a predetermined guard value allowing the discharge period to be the minimum period. In this case, since the minimum discharge period is restricted, the required energy for combustion is attained with certainty, thereby stabilizing the combustion. Further, the discharge period may be constant regardless the pressure inside the cylinder within a predetermined crank angle range at least including the compression TDC.

According to the above described embodiments, each discharge period is calculated based on the ignition timing, discharge period, the number of discharges, A/F ratio and the like. Alternatively, the discharge period may be set based on at least ignition timing and the number of discharges for substantially chasing the transition of the pressure inside the cylinder.

According to the above described embodiments, the discharge period at a multiple discharges operation is set based on A/F ratio, and these are patterned. Alternatively, only one data A/F=17 out of each A/F data may be applied. That is, the discharge period is set longest when A/F=17, out of A/F=15, 16, 17. Thus, when the data A/F=17 is used, sufficient discharge energy can be attained even when A/F is less than 17 (rich side more than A/F=17).

According to the second embodiment, as described in FIG. 12, the multiple discharges range is defined by engine rotation number Ne and engine load, and the ECU determines whether the execution of a multiple discharges operation should be done or not. Alternatively, only engine rotation number may define the multiple discharges range. That is, the multiple discharges operation is executed when the engine rotation number is less than a predetermined rotation number (low, medium rotation range). The multiple discharges operation is not executed when the engine rotation number is more than the predetermined rotation number (high rotation range). In this case, the discharge period is short and timing of stratified mixed gas reaching the ignition plug deviates from the calculated timing a little, so that the multiple discharges operation at the high rotation range is stopped.

Further, only engine load may define the multiple discharges range. That is, in the cylinder inside injection gasoline engine, combustion is changed into homogeneity combustion when an engine load becomes high, and homogeneous rich mixed gas fills the combustion chamber at the homogeneity combustion. Thus, there is no problem that timing of the mixed gas reaching the ignition plug deviates from the calculated timing. Accordingly, the multiple discharges operation is not executed within a load range where single discharge attains sufficient ignition performance like the homogeneous combustion, and the multiple discharges operation is executed within other engine load ranges.

Multiple discharges operation and single discharge operation may be switched to each other based on an engine driving condition whether it is within stratified combustion range or within homogeneity combustion range. In this case, the multiple discharges operation is executed when the engine driving condition is within the stratified combustion range.

According to the above described embodiments, when the multiple discharges operation is executed, the discharge interval and the number of discharges are variably set based on engine rotation number, engine load and ignition timing by using relations in FIGS. 5 and 6. Alternatively, the discharge interval may be set shorter and the number of discharges may be increased as A/F ratio becomes leaner.

Further, the discharge interval may be set shorter and the number of discharges may be increased as the time passed from the engine start becomes longer. At least one of discharge interval and the number of discharges may be fixed.

According to the aspect of the present invention, the discharge period is changed in accordance with pressure inside the cylinder (pressure inside the combustion chamber). Thus, it is desirable to monitor the transition of the pressure inside the cylinder and to correct the discharge period one by one based on the transition. That is, when the transition of pressure inside the cylinder is detected, the ECU 30 had better set a learning value corresponding to the transition and correct the discharge period by using the learning value. For example, the pressure inside the cylinder reduces, the ECU 30 sets a positive leaning value to correct the discharge period longer. In this way, the multiple d is charges operation is appropriately executed even at the transition.

According to the above-described embodiments, spark energy is attained from the energy accumulated in the ignition coil. Alternatively, spark energy may be attained from the energy accumulated in a condenser, for example.

Third Embodiment

Figure 15:
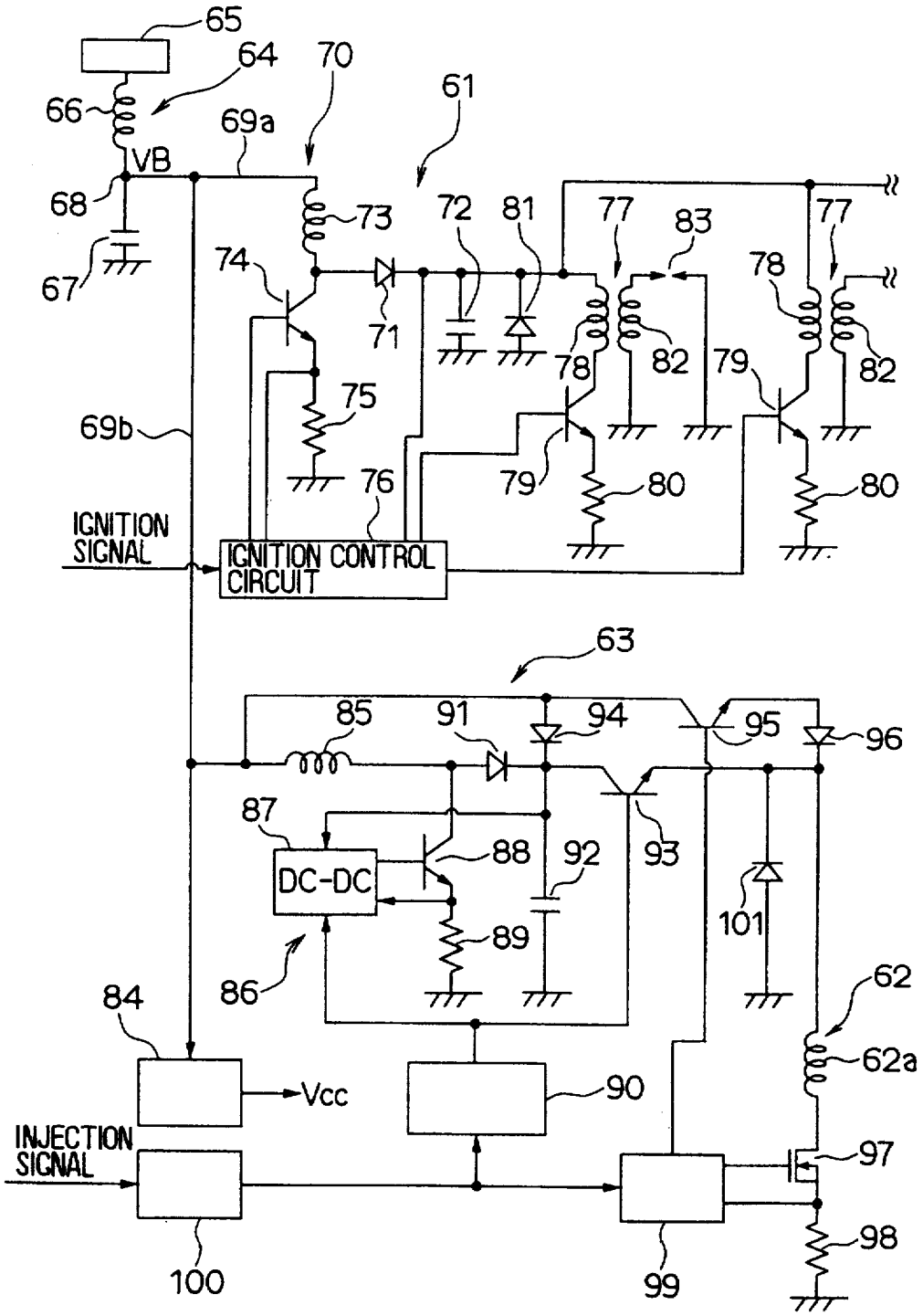
FIG. 15 is a schematic view showing an electric circuit including ignition and injection systems (third embodiment)

In the third embodiment, as shown in FIG. 15, an ignition operating circuit 61 and an injection operating circuit 63 are arranged on a single substrate. The ignition operating circuit 61 controls an ignition system, and the injection operating circuit 63 controls a fuel injection valve 62. The ignition operating circuit 61 and the injection operating circuit 63 share a battery stabilizing circuit 64. The battery stabilizing circuit 64 suppresses voltage fluctuation and noises in a battery 65. The battery stabilizing circuit 64 includes a LC low pass filter in which a coil 66 and a condenser 67 are connected in series between the positive terminal and ground terminal of the battery 65. A connection point between the coil 66 and the condenser 67 defines an output terminal 68 of the battery stabilizing circuit 64. Vehicle battery voltage VB is supplied to the ignition operating circuit 61 and the injection operating circuit 63 through the output terminal 68 and battery lines 69*a*, 69*b*.

The structure of the ignition control circuit 61 will be explained. The battery voltage VB is boosted at a booster circuit 70, and is charged into a condenser 72 through a diode 71. The booster circuit 70 includes a coil 73, a switching element 74, and a resistance 75 being connected in series. An ignition control circuit (ECU) 76 controls the on/off of the switching element 74 to boost the discharge voltage of the coil 73. While the switching element 74 is made on, the booster circuit 70 supplies an electric current into the coil 73. The ECU 76 monitors the electric current value through the terminal voltage of the resistance 75, and controls the switching element 74 to be off when the electric current value becomes a predetermined value. The ECU 76 repeats this operation to boost the discharge voltage of the coil 73 and charge it into the condenser 72. The ECU 76 monitors charged voltage in the condenser 72. When the charged voltage reaches a predetermined voltage, the ECU 76 controls the booster circuit 70 to stop boosting.

A switching element 79 is connected to a primary coil 78 of an ignition coil 77. When the switching element 79 is made on, electric charge accumulated in the condenser 72 is discharged through the primary coil 78, the switching element 79 and a resistance 80, and to the ground terminal. An ignition plug 83 is connected to a secondary coil 82 of the ignition coil 77. Here, an ignition operating circuit including the ignition plug 83, the ignition coil 77, the switching element 79, and the resistance 80 is provided in each engine cylinder. Each ignition operating circuit is operated by charged voltage in the condenser 72.

The switching element 79 intermits a primary electric current supplied into the ignition coil 77. The ECU 76 controls the on/off of the switching element 79 based on an ignition signal output from an engine control computer (not illustrated). The ECU 76 controls the switching element 79 to be on at building up timing of the ignition signal to supply the primary current into the ignition coil 77, and controls the element 79 to be off at falling down timing of the ignition signal to stop supplying the primary current into the ignition coil 77. By this, high voltage is introduced in the secondary coil 82 of the ignition coil 77 to introduce a spark discharge at the ignition plug 83. Here, when the primary current is shut off in the ignition coil 77, remaining magnetic energy in the ignition coil 77 is released through a flywheel diode 81.

The structure of the injection operating circuit 63 will be explained. The battery voltage VB is led into a constant voltage circuit 84 to be converted into constant voltage Vcc, and is used for each circuit. Further, the battery voltage VB is charged into a coil 85, and boosted at a booster circuit 86. The booster circuit 86 includes a DC-DC converter 87, a switching element 88 and a resistance 89. When output of a single stable multiple vibrator 90 is low, the DC-DC converter 87 controls the switching element 88 to be on to energize the coil 85. The electric current value is monitored through terminal voltage of the resistance 89, and the switching element 88 is controlled to be off when the electric current value becomes a predetermined value. This operation is repeated to boost the discharge voltage of the coil 85. The boosted voltage is charged into a condenser 92 through a diode 91. The DC-DC converter 87 monitors the charged voltage in the condenser 92, and stops boosting when the charged voltage reaches a predetermined voltage.

A switching element 93 energizes and de-energizes a coil 62*a* of the fuel injection valve 62, and is operated by the single stable multiple vibrator 90. When the output of the single stable multiple vibrator 90 is high, the switching element 93 is energized, and charged voltage in the condenser 92 is impressed on the coil 62*a* of the fuel injection valve 62. simultaneously, the battery voltage VB supplied through a diode 94 is also impressed on the coil 62*a*. A switching element 95 and a diode 96 are arranged in parallel in the circuits of the diode 94 and the switching element 93. When the switching element 95 is energized, the battery voltage VB is impressed on the coil 62*a* of the fuel injection valve 62 in the circuits of the switching element 95 and the diode 96.

A switching element 97 and a resistance 98 are connected in series between the coil 62*a* and the ground terminal. A constant electric current control circuit 99 controls the on/off of the switching element 97. An injection signal output from the engine control computer is input into the constant electric current control circuit 99 through a wave adjusting circuit 100. While the injection signal is input into the constant electric current control circuit 99, the circuit 99 maintains the switching element 97 to be on, and energizes the coil 62*a* to open the fuel injection valve 62. Simultaneously, the circuit 99 monitors the electric current through terminal voltage of the resistance 98, and controls the on/off of the switching element 95 to keep the electric current at a predetermined value. When the injection signal falls down, a switching element 97 is disenergized to shut off the electric current supplied into the coil 62*a*, so that the fuel injection valve 62 closes an injection port. At this time, remaining magnetic energy in the coil 62*a* is released through a flywheel diode 101.

As described above, the single stabilizing multiple vibrator 90 controls the DC-DC converter 87 and the switching element 93. An injection signal is input into the vibrator 90 through the wave adjusting circuit 100.

The single stable multiple vibrator 90 inputs a high level signal having a constant time pulse, into the DC-DC converter 87 and the switching element 93 since the injection signal builds up. While the high level signal is input, the DC-DC converter 87 is stopped to stop boosting, and the switching element 93 is maintained to be on for energizing the coil 62*a*, so that the fuel injection valve 62 opens the injection port. When the output of the single stable multi vibrator 90 changes into low level, the DC-DC converter 87 starts to work to start boosting, and the switching element 93 is disenergized to start charging the condenser 92.

Here, the pulse duration of the high level signal from the single stable multiple vibrator 90 is set smaller than that of the injection signal. Thus, even when the output from the vibrator 90 changes into low level to disenergize the switching element 93, the battery voltage VB is continuously impressed on the coil 62*a* through the switching element 95 to keep the fuel injection valve 62 to open the injection port until the fuel injection signal falls down. When the injection signal falls down, the switching element 95 is disenergized to shut the electric current supplied into the coil 62*a*, so that the fuel injection valve 62 closes the injection port.

According to the above described third embodiment, since the ignition operating circuit 61 and the injection operating circuit 63 are arranged on the single substrate, the wiring pattern is easily made between the ignition operating circuit 61 and the injection operating circuit 63, and the ignition operating circuit 61 and the injection operating circuit 63 commonly share the battery stabilizing circuit 64. Therefore, the circuit structure of the ignition and injection systems, and the assembling procedure are simplified, thereby reducing the manufacturing cost.

The present invention is not limited to the present embodiment in which the ignition operating circuit 61 and the injection operating circuit 63 are arranged on the single substrate. For example, the ignition operating circuit 61 and the injection operating circuit 63 may be independently arranged on separated substrates, and both circuits 61, 63 may be contained in a single casing. Further, the ignition operating circuit 61 and the injection operating circuit 63 may share function devices commonly used for both circuits 61, 62 other than the battery stabilizing circuit 64.

Fourth Embodiment

The fourth embodiment of the present invention will be explained with reference to FIGS. 16–19.

Figure 16:
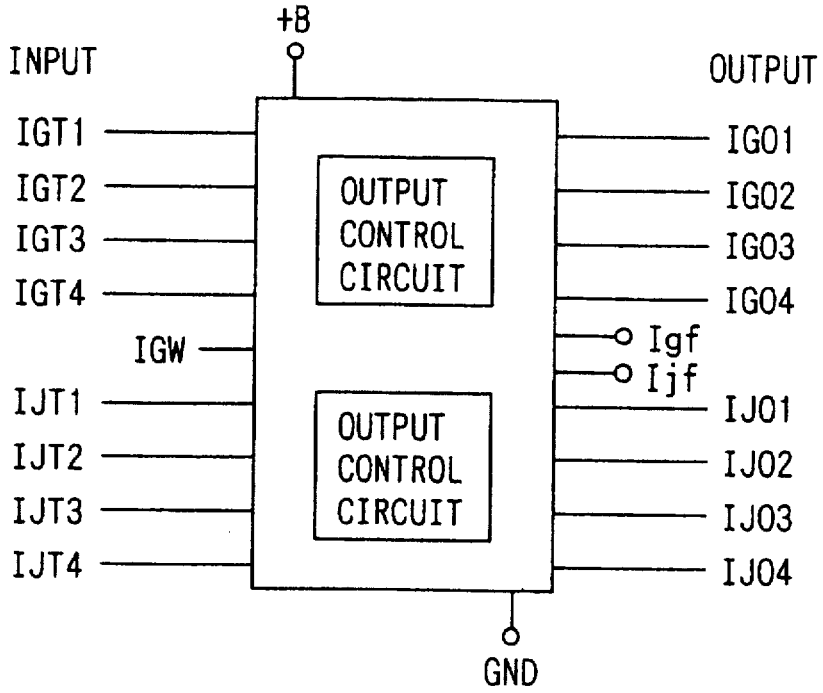
FIG. 16 PRIOR ART
FIG. 16 shows signal lines of ECU (Prior Art)

FIG. 16 shows a diagram of conventional signal lines from an engine control computer (ECU) for a four cylinders engine. The signal lines include ignition signals IGT1–IGT4 and injection signals IJT1–IJT4 for the cylinders. The conventional ECU outputs the ignition signals. IGT1–IGT4 and the injection signals IJT1–IJT4 independently from separated output ports of each cylinder. Thus, it is necessary to provide eight signal lines to output the ignition signals IGT1–IGT4 and the injection signals IJT1–IJT4 for four cylinders, thereby increasing the number of signal lines.

Figure 17:
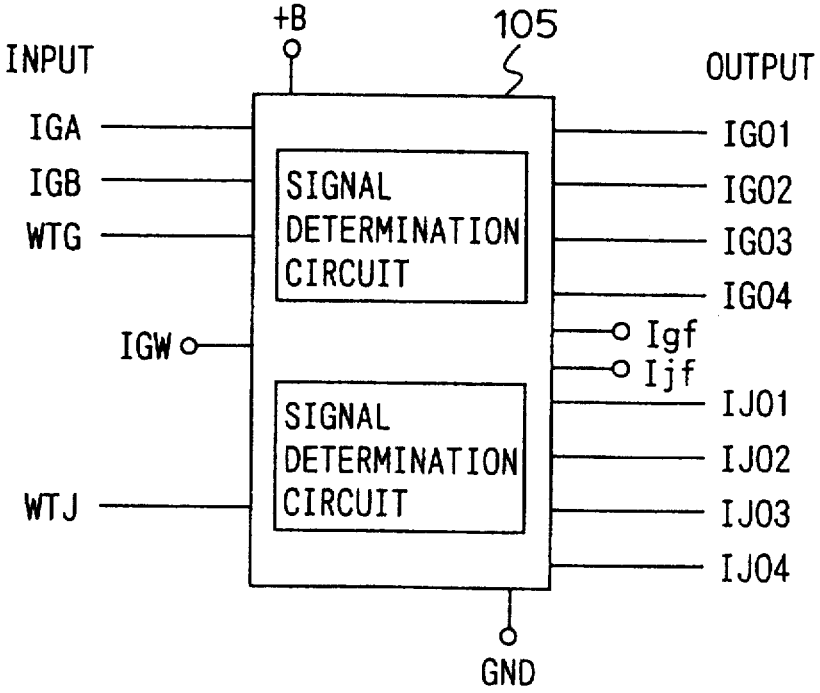
FIG. 17 shows signal lines of ECU (fourth embodiment)
Figure 19:
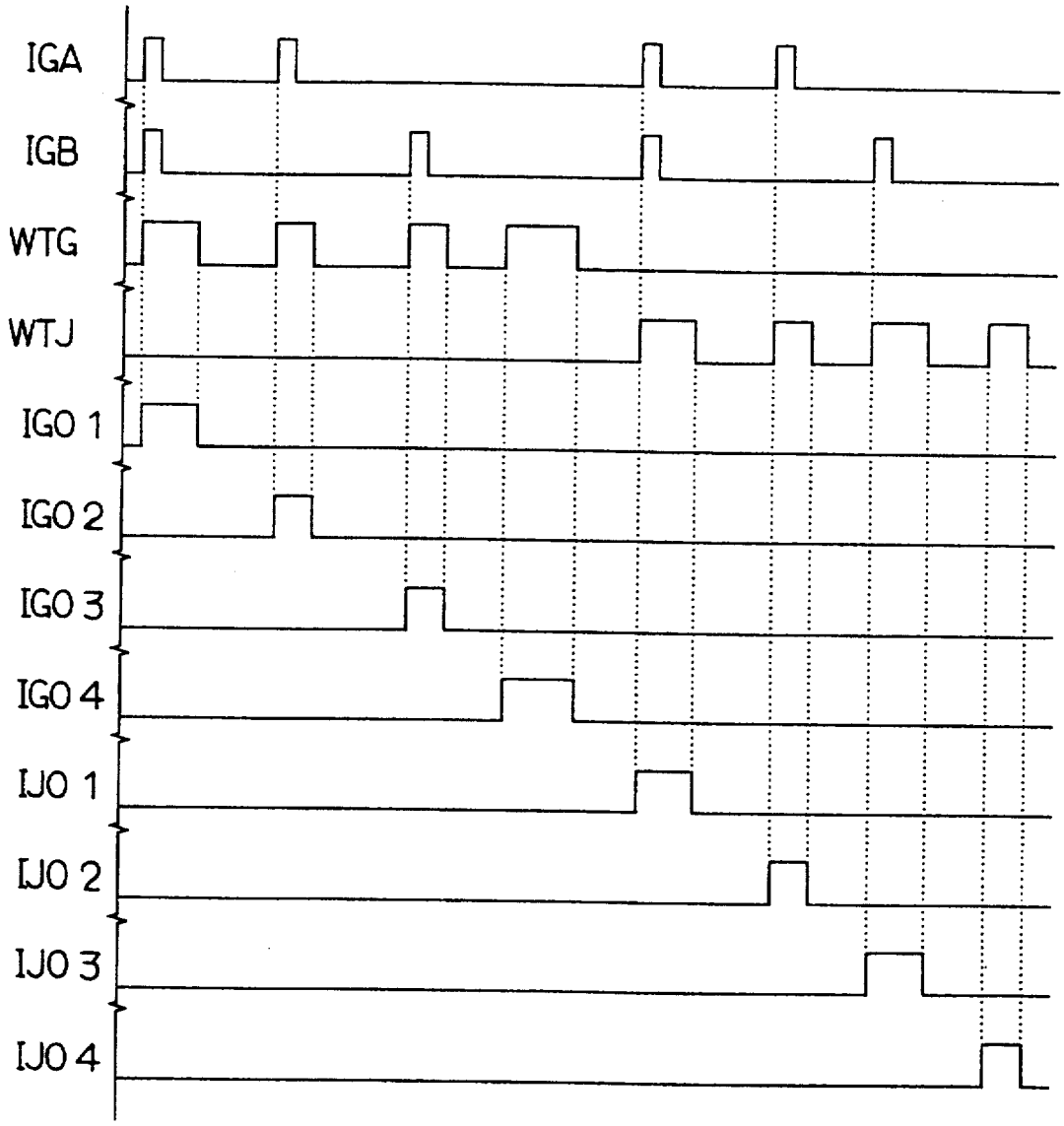
FIG. 19 is a time chart showing each pulse wave (fourth embodiment)

According to the fourth embodiment, signal lines are arranged as shown in FIGS. 17–19 to reduce the number of signal lines. FIGS. 17–19 show the present invention applied to a four cylinders engine. The ECU outputs cylinder determination signals IGA, IGB, an ignition determination signals WTG, and an injection determination signal WTJ into a signal determining circuit 105. The signal determining circuit 105 determines which one of eight combinations in FIG. 18 does the on/off combination of these signals IGA, IGB, WTG, WTJ correspond to. That is, the signal determining circuit 105 carries out cylinder determination based on the on/off combinations of the cylinder determination signals IGA, IGB, and carries out ignition/injection determination based on the on/off combinations of the ignition determination signal WTG and the injection determination signal WTJ. The signal determining circuit 105 outputs ignition signal IGO1–IGO4 and injection signal IJO1–IJO for each cylinder into an ignition operating circuit (not illustrated) and an injection operating circuit (not illustrated).

Further, as shown in FIG. 19, the ECU changes the pulse durations of the ignition determination signal WTG and the injection determination signal WTJ in accordance with ignition period and injection period. The signal determining circuit 105 determines a pulse duration (ignition period) of the ignition signals IGO1–1GO4 in accordance with the pulse duration of the ignition determination signal WTG, and determines a pulse duration (injection period) of the injection signals IJO1–1JO4 in accordance with the pulse duration of the injection determination signal WTJ. Here, the above-described signal determining circuit may be constructed by a theoretical circuit.

Figure 20:
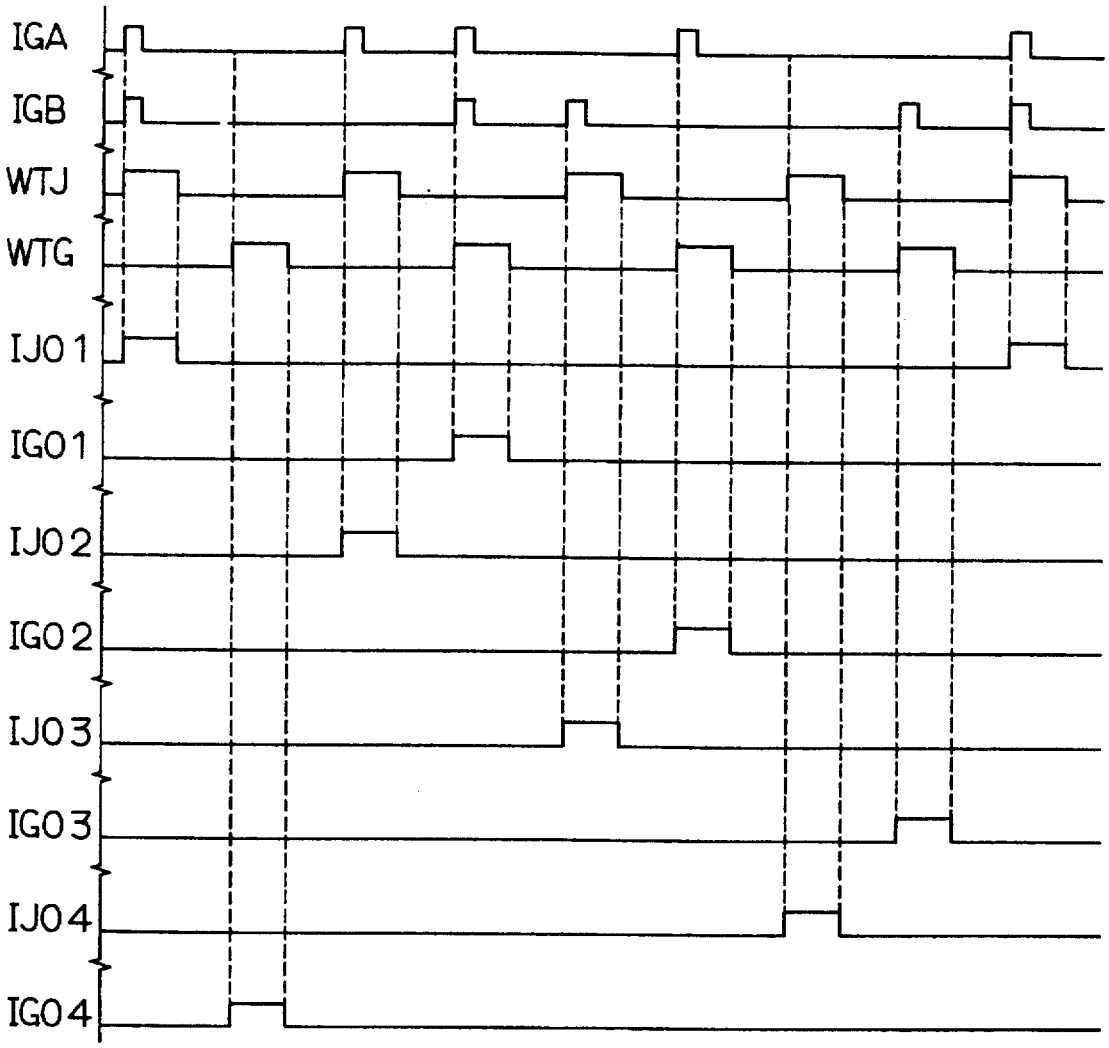
FIG. 20 is a time chart showing each pulse wave (fourth embodiment)

FIG. 20 is a time chart showing actual ignition signal and injection signal at an independent injection of intake pipe injection. IGO1–1GO4 denote ignition signals of first through fourth cylinders, respectively. IJO1–1JO4 denote injection signals of first through fourth cylinders, respectively. Here,the first cylinder defines a cylinder firstly injecting and igniting out of the four cylinders. Signals are output in the following orders;

Injection signal of first cylinder→ignition signal of fourth cylinder→injection signal of second cylinder→ignition signal of first cylinder→injection signal of third cylinder→ignition signal of second cylinder→injection signal of fourth cylinder→ignition signal of third cylinder; After that, the above cycle is repeated.

The injection signal indicates an intake stroke, and the ignition signal indicates an explosion stroke. Ignition signal and injection signal for another cylinder are once output between injection signal and ignition signal for one cylinder. Further, injection signal and ignition signal for another cylinder is twice output between injection signal and ignition signal for one cylinder.

In the independent injection, since timings of same stroke for each cylinder deviate from each other, timings of on/off signals of IGA and IGB slightly deviate from each other. Thus, ignition signals and injection signals determined based on combinations of the signals does overlap each other, thereby improving the cylinder determination.

The signal determining circuit 105 includes a input terminal IGW setting the number of ignitions to be applied to multiple ignitions. The signal determining circuit 105 includes a monitor circuit (not illustrated) monitoring ignition/injection operation, and includes output terminals Igf, Ijf outputting ignition monitor signal and injection monitor signal respectively. The ECU detects the ignition monitor signal and the injection monitor signal to determine whether the ignition/injection operation is correctly carried out or not.

As described above, cylinder determination and ignition/injection determination are carried out based on the on/off combinations of four signals IGA, IGB, WTG, WTJ. The pulse duration (ignition period) of ignition signals IGO1–IGO4 and the pulse duration (injection period) of injection signals IJO1–IJO4 are determined based on the pulse durations of ignition determination signal WTG and injection determination signal WTJ. Thus, the number of signal lines from the ECU is made half of the conventional signal lines, so that a space on which the signal lines are arranged is compacted and the signal lines are easily arranged, thereby reducing the manufacturing cost.

The present invention is not limited to four cylinders engine. Even when the present invention is used for three cylinders engine, the number of signal lines from the ECU is reduced in comparison with the conventional signal lines. When the present invention is used for over four cylinders engine, the number of signal lines is reduced less than the half of the conventional signal lines. For example, when the present invention is used for six cylinders engine, the number of signal lines is reduced from twelve in the conventional signal lines arrangement, to five (three cylinder determination lines, one ignition determination line, and one injection determination line).

Further, signals for determining pulse durations of ignition signals IGO1–IGO4 and injection signals IJO1–IJO2 may be output independently from ignition determination signal WTG and injection determination signal WTJ.

In the present embodiment, the determining method for the signals from the signal determining circuit 55 may be changed appropriately. For example, cylinder determination and ignition/injection determination may be carried out based on pulse duration or pulse number during a predetermined period of output signal from the ECU.

Fifth Embodiment

Figure 21:
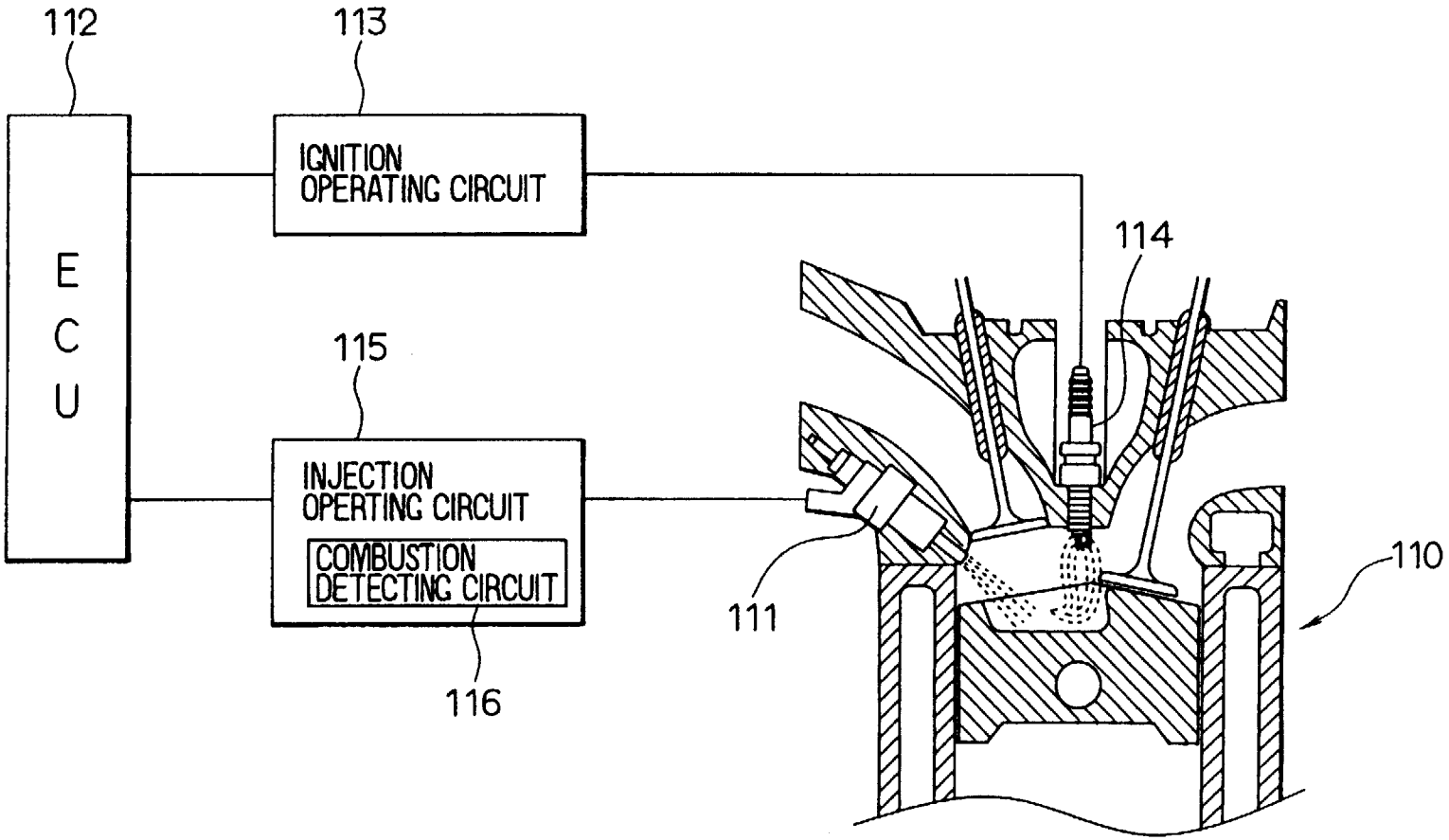
FIG. 21 is a schematic view showing ignition and injection system (fifth embodiment)

In the fifth embodiment, as shown in FIG. 21, an engine 110 is an injection inside cylinder type engine in which a fuel is directly injected from a fuel injection valve 111 into the inside of a cylinder. An ECU 112 outputs an ignition signal into an ignition operating circuit 113 while synchronizing the spark timing of each cylinder to introduce a spark discharge at an ignition plug 114 of each cylinder. Further, the ECU 112 outputs an injection signal into an injection operating circuit 115 while synchronizing the injection timing of each cylinder to allow the injection valve to open the nozzle of each cylinder, so that the fuel is directly injected into the cylinder.

According to the present fifth embodiment, a piezoelectric element is used for operating the fuel injection valve 111. When the fuel is injected, the piezoelectric element is energized to allow the fuel injection valve to open the injection port. When the fuel injection is finished, the piezoelectric element is de-energized to allow the fuel injection valve 111 to close the injection port. In the injection inside cylinder type engine 110, since the injection port of the injection valve 111 exposes to the inside of the cylinder, combustion pressure inside the cylinder acts on a needle of the injection valve 111, and the combustion pressure acts on the piezoelectric element through the needle. Thus, electric voltage is introduced in the piezoelectric element in accordance with the increase of fuel combustion pressure inside the cylinder.

In the fifth embodiment, an injection operating circuit 115 includes a combustion detecting circuit 116 detecting the electric voltage arising in the piezoelectric element. A combustion state (for example, whether there is an accidental fire or not, pre-ignition etc.) is detected based on the voltage of the piezoelectric element through the combustion detecting circuit 116. In this way, the piezoelectric element, which operates the fuel injection valve 111, is used as a combustion sensor, so that there is no need to provide an additional combustion sensor for each cylinder, thereby reducing the cost.

The present invention is not limited to the fuel injection valve operated by the piezoelectric element. Alternatively, a fuel injection valve operated by an electromagnet may be used. In this case, electric voltage arising in an electromagnetic coil of the electromagnet in accordance with the increase of combustion pressure may be see to detect a combustion state.

Sixth Embodiment

Figure 22:
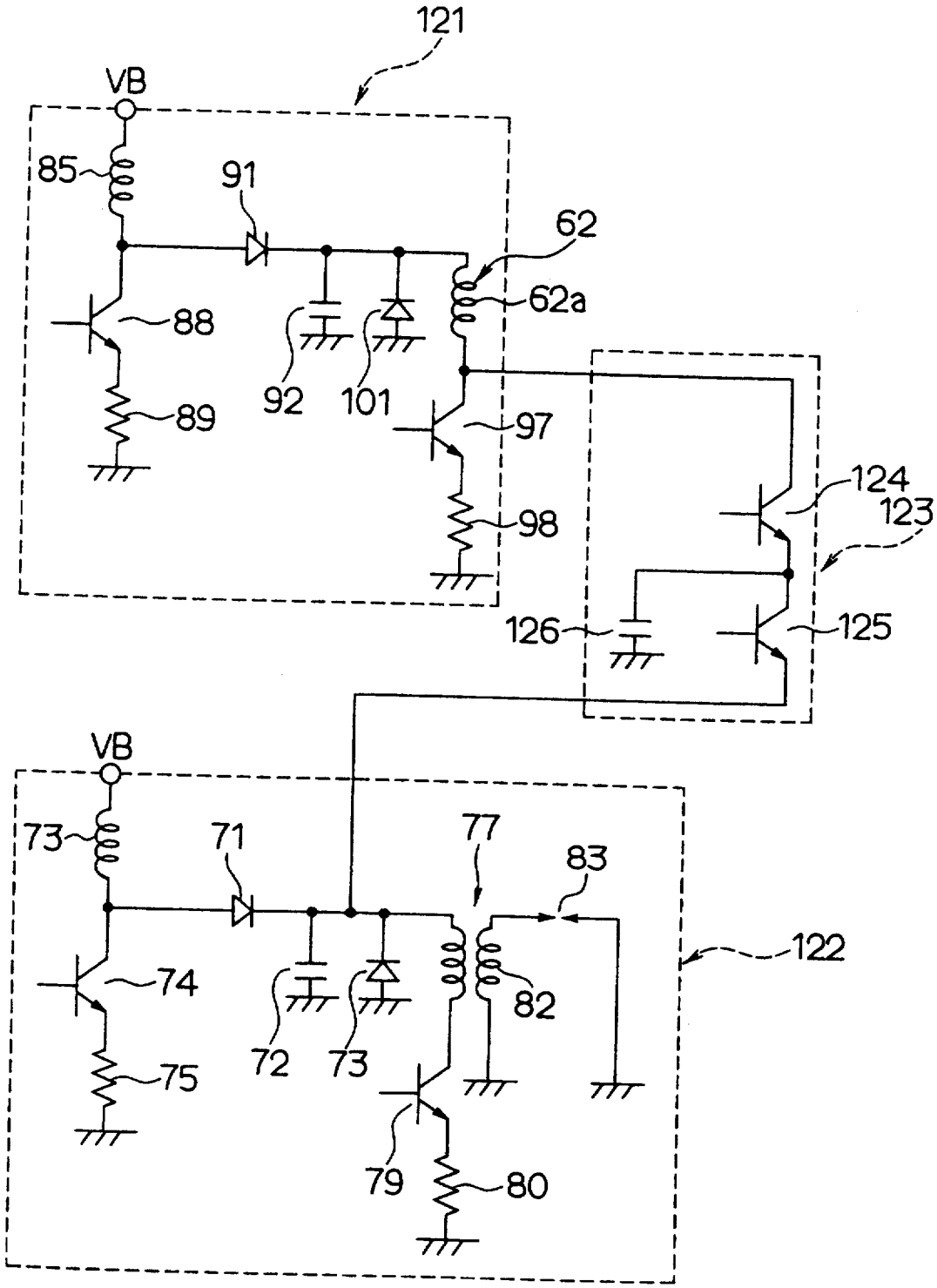
FIG. 22 is a schematic view showing an electric circuit including ignition and injection systems (sixth embodiment).

In the sixth embodiment, as shown in FIG. 22, an injection operating circuit 121 and an ignition operating circuit 122 are arranged on a single substrate (not illustrated) as in the third embodiment. FIG. 22 is a schematic view showing an arrangement of the injection operating circuit 121 and the ignition operating circuit 122. Structures of both circuits 121, 122 are substantially the same as in the third embodiment.

According to the present sixth embodiment, an energy recovery circuit 123 is provided. The energy recovery circuit 123 gets back remaining magnetic energy in the coil **62*a* of the fuel injection valve 62 when the injection operating circuit 121 finishes injecting fuel, and supplies the energy into the ignition operating circuit 122. The energy recovery circuit 123 includes switching elements 124, 125 and a condenser 126 for getting back the energy. The switching elements 124 and 125 are connected in series between the ground side of the coil 62*a* and the positive side of the condenser 77 of the ignition operating circuit 122. The condenser 126 is connected between a connection point of both switching elements 124, 125 and the ground terminal. The energy recovery circuit 123** is also arranged on the same single substrate.

When the fuel injection valve opens the injection port, the switching element 97 of the injection operating circuit 121 is made on to energize the coil **62*a*, and the switching elements 124, 125 of the energy recovery circuit 123 are made off. When the fuel injection is completed, the switching element 97 is made off to stop supplying the electric current into the coil 62*a*, and the upper switching element 124 is made on. By this, when the fuel injection is completed, the energy recovery circuit 126 gets back the remaining magnetic energy in the coil 62*a* through the switching element 124**.

After that, the upper switching element 124 is made off, and the lower switching element 124 is made on, so that accumulated electric charge in the condenser 126 is charged into the condenser 72 of the ignition operating circuit 122 through the lower switching element 125. After the condenser 126 discharges, the lower switching element 125 is made off to prevent the electric current from flowing back from the ignition operating circuit 122 to the condenser 126. The on/off operation of the switching element 74 of the ignition operating circuit 122 is repeated to boost and charge output voltage of the coil 73 into the condenser 72. The charged voltage in the condenser 72 supplies a primary electric current into the ignition coil 77. When the ignition signal falls down, the switching element 79 is made off to shut the primary electric current in the ignition coil 77. By this, high voltage arises in the secondary coil 82 of the ignition coil 77 to introduce a spark discharge at the spark plug 83.

As described above, the energy recovery circuit 123 gets back the remaining magnetic energy in the coil **62*a*, and supplies the energy into the ignition operating circuit 122**. Thus, the remaining magnetic energy is effectively consumed, thereby improving fuel consumption.

Here, alternatively or additionally, another energy recovery circuit may be provided to get back a remaining energy in the ignition operating circuit and supply the energy into the injection operating circuit 121.

The invention disclosed in the sixth embodiment is not limited to the example in which the injection operating circuit 121, the ignition operating circuit 122 and the energy recovery circuit 123 are arranged on the single substrate. For example, an injection operating circuit 121 and an ignition operating circuit 122 may be independently arranged on separated substrates, and an energy recovery circuit 123 may be arranged on one of the separated substrates. Alternatively, an energy recovery circuit 123 may be arranged on an independent substrate separated from the substrates on which both circuits 121, 122 are arranged.

Further, above described third through sixth embodiment may be appropriately combined.

What is claimed is:

1. An ignition control apparatus for an internal combustion engine comprising:

an ignition plug provided in said internal combustion engine;

an igniter introducing spark discharge in said ignition plug at an ignition timing; and an ignition control means executing a multiple discharges operation in which a plurality of discharges are carried out during one combustion cycle of said internal combustion engine, wherein said ignition control means changes a discharge period of each discharge during the multiple discharges operation, and said ignition control means changes the discharge period of each discharge in accordance with a pressure transition in a combustion chamber of said internal combustion engine.

2. An ignition control apparatus according to claim 1, wherein said ignition control means sets the discharge period longer as fuel-air mixed gas supplied into said internal combustion engine is leaner.

3. An ignition control apparatus according to claim 1, wherein said ignition control means determines the number of discharges during the one combustion cycle based on a driving condition of said internal combustion engine.

4. An ignition control apparatus according to claim 1, wherein said ignition control means determines an interval of said each discharge based on a driving condition of said internal combustion engine.

5. An ignition control apparatus according to claim 1, further comprising an ignition timing retarding means for retarding the ignition timing when said internal combustion engine cold starts, wherein said ignition control means executes the multiple discharges operation in accordance with the ignition timing retardation when said internal combustion engine starts.

6. An ignition control apparatus according to claim 1, wherein said ignition control apparatus is used for an injection inside cylinder type internal combustion engine in which a fuel is directly injected into a combustion chamber thereof, and said ignition control means executes the multiple discharges operation in accordance with a driving range of said injection inside cylinder type internal combustion engine.

7. An ignition control apparatus according to claim 1, wherein said igniter includes an ignition coil introducing the spark discharge in said ignition plug, said ignition control means repeatedly energizes and de-energizes a primary side of said ignition coil by plural times during the one combustion cycle of said internal combustion engine to execute the multiple discharges operation.

8. An ignition control apparatus for an internal combustion engine comprising:

an ignition plug provided in said internal combustion engine;

an igniter introducing spark discharge in said ignition plug at an ignition timing; and an ignition control means executing a multiple discharges operation in which a plurality of discharges. are carried out during one combustion cycle of said internal combustion engine, wherein said ignition control means sets a discharge period of each discharge during the multiple discharges operation in such a manner that the discharge period is set shorter as the discharge timing more closes to a compression top dead center.

9. An ignition control apparatus for an internal combustion engine comprising:

an ignition plug provided in said internal combustion engine;

an igniter introducing spark discharge in said ignition plug at an ignition timing; and an ignition control means executing a multiple discharges operation in which a plurality of discharges are carried out during one combustion cycle of said internal combustion engine, wherein said ignition control means changes a discharge period of each discharge during the multiple discharges operation.

10. An ignition control apparatus according to claim 9, wherein said ignition control means restrict a range of the discharge period by a predetermined guard setting minimum discharge period.

* * * * *

UNITED STATES PATENT AND TRADEMARK OFFICE
Certificate

Patent No. 6,694,959 B1 Patented: February 24, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Tetsuya Miwa, Nagoya, Japan; and Tomonari Chiba, Nishikamo, Japan.

Signed and Sealed this Twenty-eighth Day of June 2005.

HENRY YUEN
*Supervisory Patent Examiner*
Art Unit 3747